US007305717B1

(12) United States Patent
Brown

(10) Patent No.: US 7,305,717 B1
(45) Date of Patent: Dec. 11, 2007

(54) CLOTHING FOR AUTISTIC CHILDREN

(76) Inventor: Michelle Brown, 1538 Blue Heron Ct., Orange Park, FL (US) 32003

( * ) Notice: Subject to any disclaimer, the term of this patent is extended or adjusted under 35 U.S.C. 154(b) by 188 days.

(21) Appl. No.: 11/255,662

(22) Filed: Oct. 21, 2005

(51) Int. Cl.
*A41D 11/00* (2006.01)
*A41D 10/00* (2006.01)

(52) U.S. Cl. ..... 2/114; 2/80; 2/269

(58) Field of Classification Search ..... 2/114, 2/75, 80, 269; 24/387, 429, 432
See application file for complete search history.

(56) References Cited

U.S. PATENT DOCUMENTS 2,905,944 A * 9/1959 Stuart et al. ..... 2/83
3,397,406 A 8/1968 Leach
3,448,463 A * 6/1969 Gaetano ..... 2/234
4,068,316 A * 1/1978 Haywood ..... 2/126
4,575,873 A * 3/1986 Smith ..... 2/234
4,697,288 A * 10/1987 Palumbo ..... 2/269
4,773,101 A * 9/1988 Kapp et al. ..... 2/69.5
5,088,128 A * 2/1992 Kape ..... 2/269
5,138,717 A * 8/1992 Tolton ..... 2/123
5,208,918 A 5/1993 Royal
5,418,978 A * 5/1995 Hochman ..... 2/69
5,911,312 A 6/1999 Holyfield
6,058,508 A * 5/2000 Brown Honeysuckle ..... 2/69
6,260,200 B1 7/2001 Alfred
6,339,847 B1 * 1/2002 Hanks ..... 2/269
6,401,249 B2 * 6/2002 Haar et al. ..... 2/69
6,654,968 B2 * 12/2003 Braun et al. ..... 2/269
2003/0145636 A1 * 8/2003 Nykoluk ..... 70/68

* cited by examiner

*Primary Examiner*—Alissa Hoey
(74) *Attorney, Agent, or Firm*—Lawrence J. Gibney, Jr.

(57) ABSTRACT

This is specially designed clothing for autistic children. It may however also be used for children or adults who are physically or mentally infirm and provides a means to secure the clothing and provide a means to shorten the clothing.

1 Claim, 4 Drawing Sheets

CLOTHING FOR AUTISTIC CHILDREN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to clothing needs for an autistic child. Autistic children have special needs with regard to clothing and need to remain in their clothing. It is not unusual for an autistic child to want to break free of the clothing. Unfortunately, when that happens the caretaker has great difficulty in getting the clothing back on and ensuring that the clothing remains clean.

B. Prior Art

There are other patent references for protective clothing for elderly or inform patients not only autistic children but also adults. A representative example of this is Holyfield U.S. Pat. No. 5,911,312. Another example is Royal U.S. Pat. No. 5,208,918.

The present application uses a unique securing system at the top of the back of the neck area in order to ensure that the child remains in the clothing and therefore is different from the previously mentioned prior art.

BRIEF SUMMARY OF THE INVENTION

This clothing is specially designed for autistic children. However, it may be used for other children or adults who are physically or mentally infirm. Caretakers whether a parent, guardian or some other individual are generally involved with this population.

One of the difficulties in treating or caring for a physically or mentally infirm individual is the tendency of the person to attempt to get out of the clothing. Unfortunately, this causes a great deal of difficulty for the caretaker as the individual must now work to get the person back into the clothing. Additionally, some individuals who are mentally infirm will sometimes defecate and spread waste material once out of the clothing onto walls or furniture. This, of course, is a very undesirable result.

It is an object of this particular device to ensure that a child or physically or mentally infirm adult or child remains in clothing for the convenience of the caretaker. This is accomplished by a special type of securement means which is not found in the prior art.

DETAILED DESCRIPTION OF THE EMBODIMENTS

Clothing of course is absolutely essential. However, special needs should be addressed when dealing with clothing for mentally or physically infirm individuals.

Figure 1:
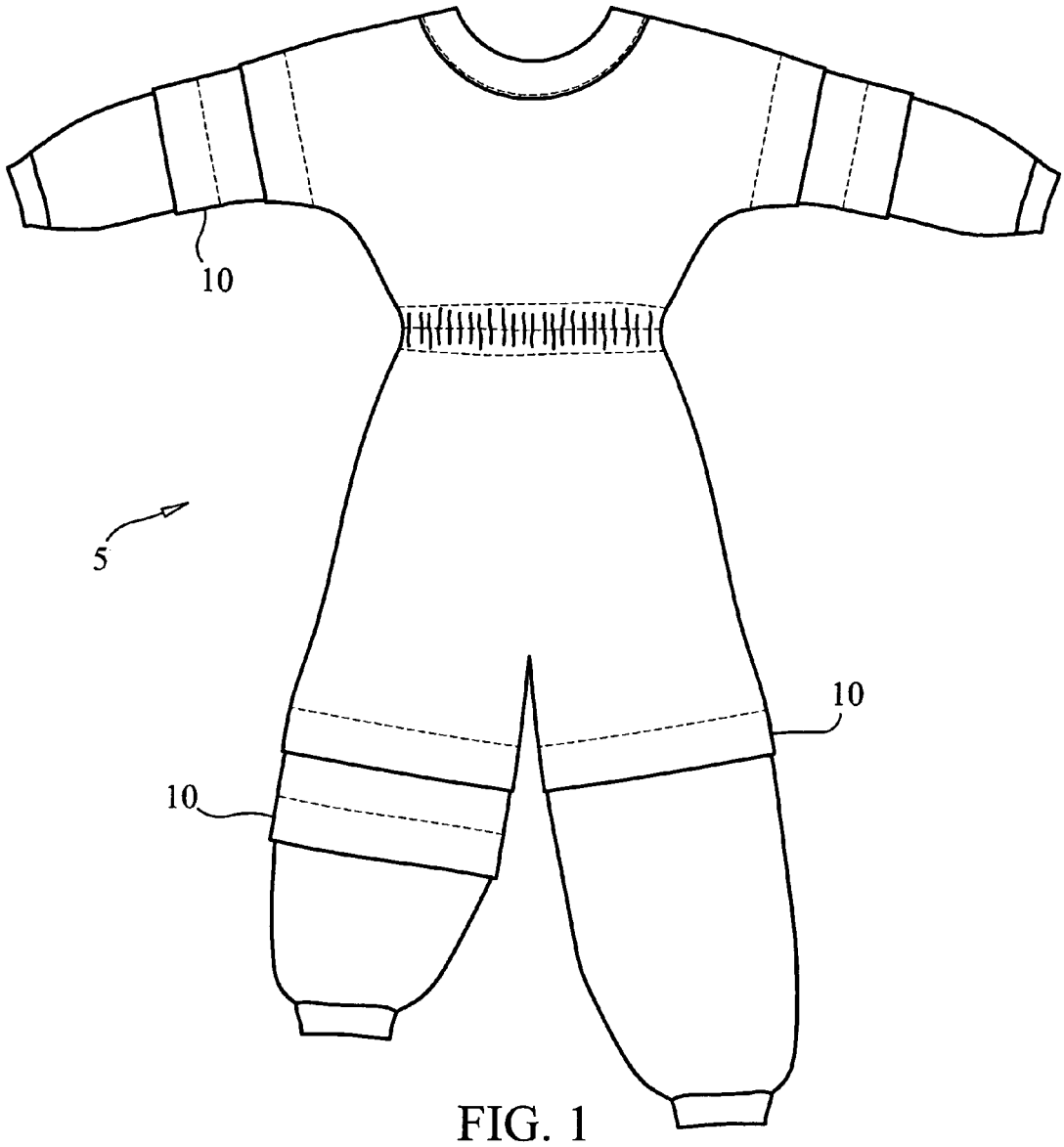
FIG. 1 is a front view of the clothing.

This type of clothing 5 allows an individual to be secured into the clothing and remain in the clothing for as long as needed. The clothing will have a special feature to add or delete length to the arms or legs by removing or adding seams 10 in the arms or legs to add or delete parts of the clothing. This would allow the individual to grow into the clothing or conversely would allow the clothing to be worn by a variety of body types. FIG. 1 It is contemplated that a zipper will be provided in the back of the clothing and that the article of clothing is one piece.

Figure 2:
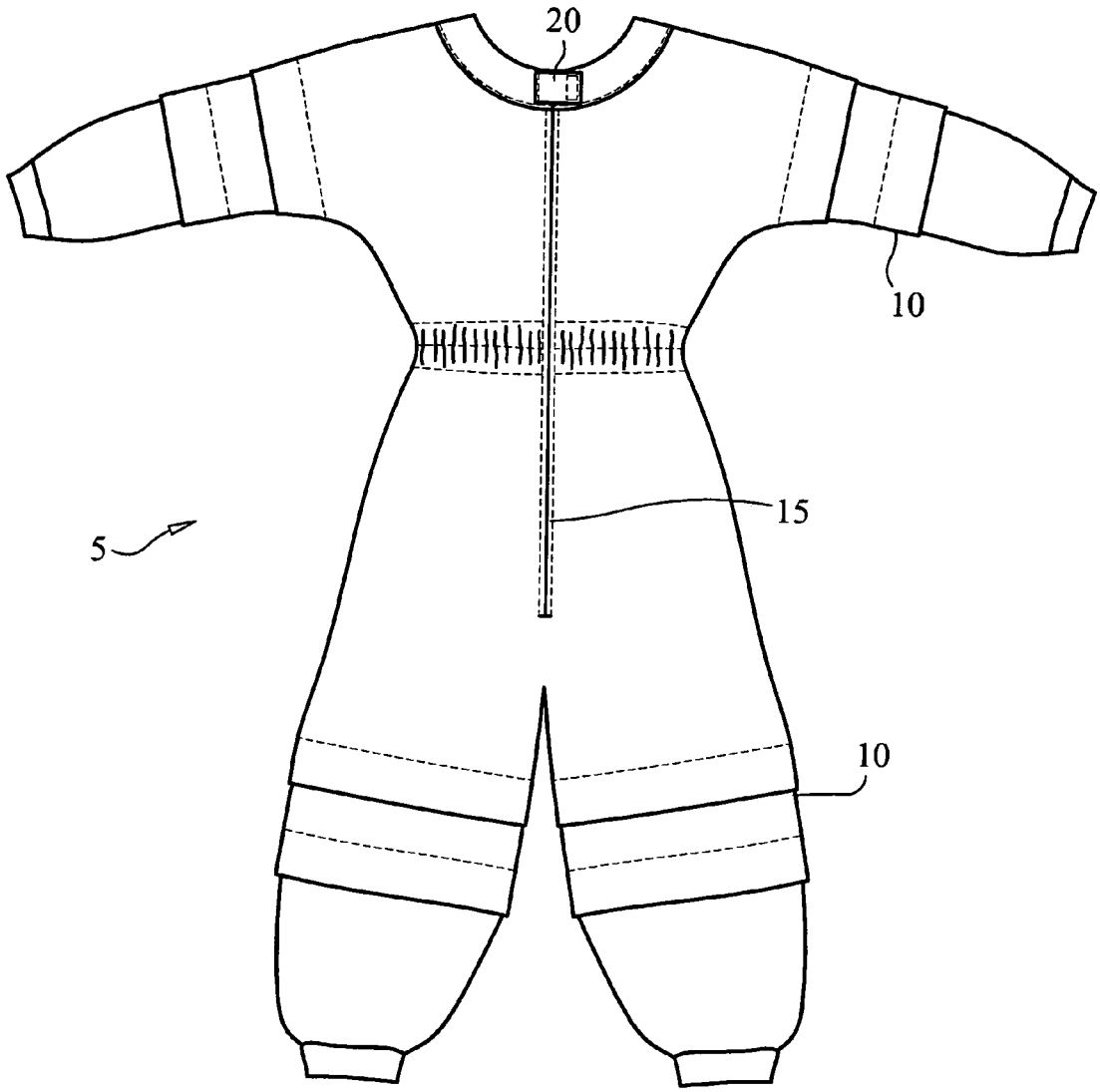
FIG. 2 is a back view of the clothing.
Figure 3:
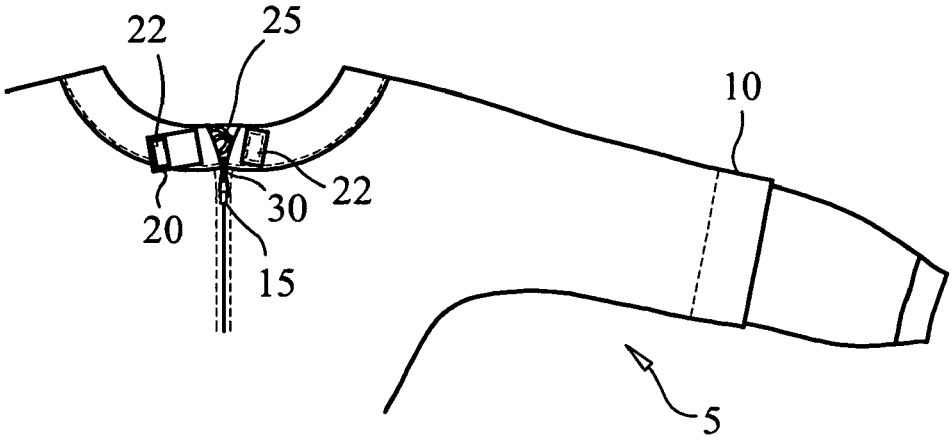
FIG. 3 is a fragmented view of the securing mechanism.
Figure 4:
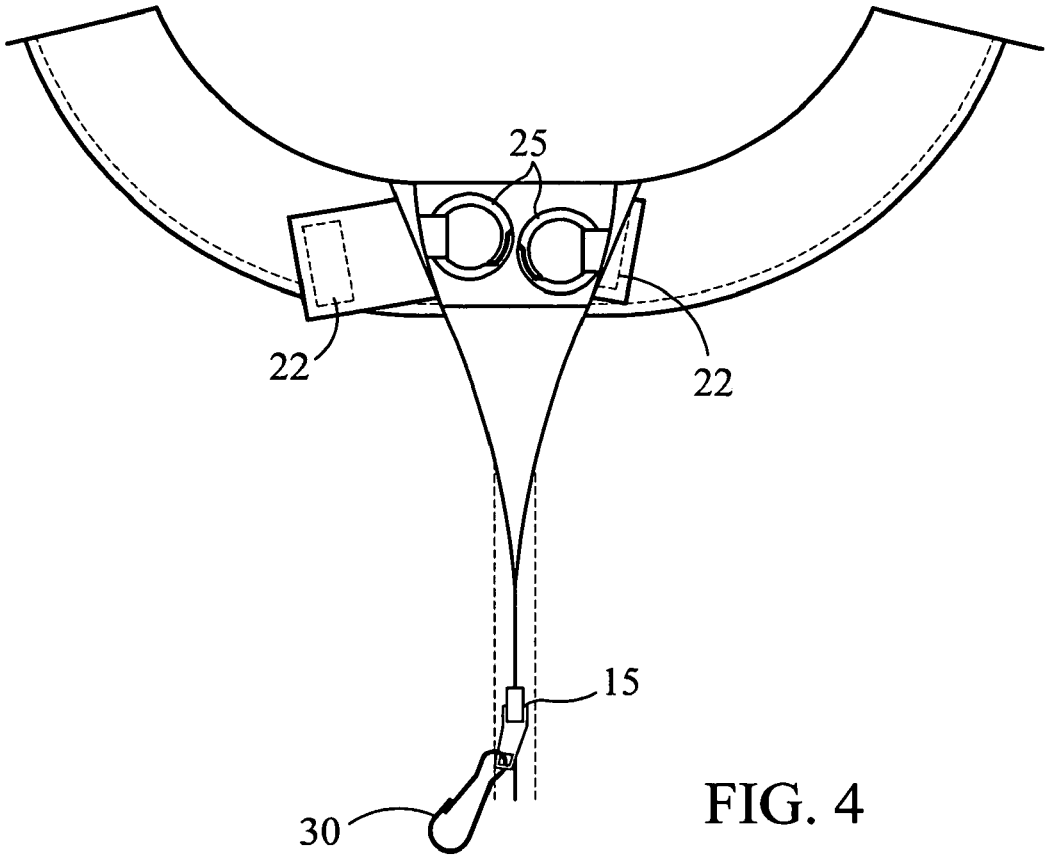
FIG. 4 is a close up view of the securing mechanism in the back.

On the back of the device will be a special securement means, which is placed near the top of the neck of the individual on the back of the neck and near one end of the zipper 15. FIGS. 2, 3, 4

It will be comprised of a set of rings 25, which each have a beveled opening, which will interconnect; this type of connecting rings enable the caretaker to swiftly connect the two rings using the openings in the rings. This dual ring system is also difficult for an individual to detach from the back working blindly. The rings 25 may be made from plastic or aluminum or some other suitable material.

Additionally, there will be a separate clip 30, which is attached to the clothing zipper 15, which will be fastened in one or both of the rings 25, once the rings are secured together. These rings 25 with the clip 30 provide a unique way to secure clothing 5 in the back and provide the securement means.

A flap 20, which is comprised of two parts attached to the clothing near the top of the neck, will cover the securement means to insure that the rings 25 and clip 30 remain in place and create another barrier for the individual in terms of undressing. It is anticipated that a hook and loop assembly 22 on the respective parts of the flap will cover the rings 25 and clip 30 once connected. A button and snap assembly may also be used for the securement means. The flap 20 will cover the entire assembly so that the individual will have a difficult time getting out of the clothing; the respective portions of the flap will have the various parts of the flap securement means. FIGS. 2, 4

In order to get out of the clothing the individual would need to undo the flap 20, remove the clip 30, and undo the rings 25 while doing it blind or behind his or her back. This would be a very difficult task indeed and one likely not to occur. FIGS. 2, 3, 4

Alternate Embodiment

Figure 5:
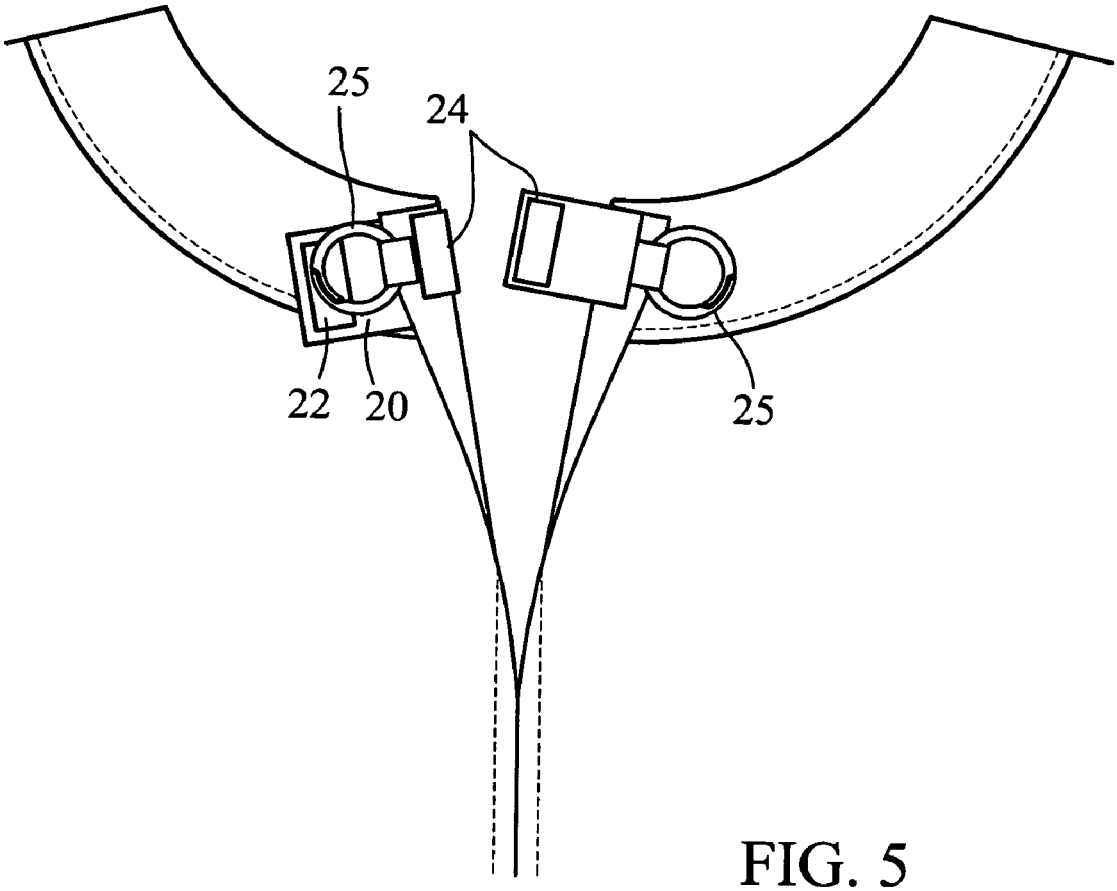
FIG. 5 is an alternate method to secure the clothing.

In order to fortify the area around the top of the back of the neck a device to secure the respective parts using a male and female joinder device 24 may be used. The clip 30 is not shown in this embodiment as depicted by FIG. 5, although it will be used in the alternate embodiment. The operation of the device in terms of securing it to the top of the back of the neck would remain the same. FIG. 5

The invention claimed is:

1. A device to secure clothing to a child or adult, which is comprised of:

a. clothing;

wherein the clothing has a set of seams at predetermined positions on the arms and legs to shorten sections of the arms or legs;

wherein a zipper is provided on the back of the clothing;

b. means to secure the clothing at the child or adult's neck;

wherein the zipper extends to the securement means at the top of the back clothing portion adjacent to the child or adult's neck;

wherein a plurality of rings are used;

said rings are provided with openings by which the rings can be connected;

said rings have beveled openings which interconnect;

c. clip;

wherein a clip is secured to the rings when they are connected;

said clip is connected to the zipper of the clothing;

d. flap;

wherein the flap has sections that are secured to the clothing near the top of the back portion adjacent to the neck of the child or adult;

wherein the flap covers the rings and the clip once secured;

wherein the flap has an end with a means to secure the end of the flap to the back of the clothing portion.

* * * * *